United States Patent [19]

Tonning et al.

[11] Patent Number: 4,744,595

[45] Date of Patent: May 17, 1988

[54] HOISTING APPARATUS FOR GROUPWISE TRANSFER OF CARGO UNITS, SUCH AS PAPER ROLLS

[75] Inventors: Erling Tonning; Jacob S. Halvorson, both of Oslo, Norway

[73] Assignee: Leif Hoegh & Co. A/S, Oslo, Norway

[21] Appl. No.: 885,580

[22] PCT Filed: Oct. 31, 1985

[86] PCT No.: PCT/N085/00070

§ 371 Date: Sep. 8, 1986

§ 102(e) Date: Sep. 8, 1986

[87] PCT Pub. No.: WO86/02915

PCT Pub. Date: May 22, 1986

[30] Foreign Application Priority Data

Nov. 9, 1984 [NO] Norway ..... 844480

[51] Int. Cl.[4] ..... B66G 1/02

[52] U.S. Cl. ..... 294/65; 294/81.2; 294/81.4; 414/730; 414/737

[58] Field of Search ..... 294/65, 67.31, 67.33, 294/81.1, 81.2, 81.4, 81.41, 87.1, 87.12, 907; 414/730, 737, 627

[56] References Cited

U.S. PATENT DOCUMENTS 3,610,673 10/1971 Strombeck et al. ..... 294/65

3,831,992 8/1974 Francois ..... 294/65

*Primary Examiner*—James B. Marbert

*Attorney, Agent, or Firm*—Ladas & Parry

[57] ABSTRACT

A positioning device for a hoisting bank with a plurality of horizontally adjustable gripper means, such as vacuum cups, for groupwise handling of cargo units, such as paper rolls. The hoisting bank is of a kind including one or more guiding arms adapted for contacting the cargo units in the group to be lifted enabling the crane operator to adjust, if necessary, the center distance between the gripper means relative to the center distance between the cargo units prior to that the gripper means are positioned on the cargo units. In accordance with the invention at least one of the guiding arms (24) is provided with sensors (40, 30, 32) adapted for upon contacting an adjacent cargo unit (20) or units (20,20) and in dependence upon the outer contour of the cargo unit in question, to effect automatic extension, respectively retraction of the center distance of the gripper means (12) in dependence upon the center distance between the cargo units (20) in the group.

11 Claims, 3 Drawing Sheets

HOISTING APPARATUS FOR GROUPWISE TRANSFER OF CARGO UNITS, SUCH AS PAPER ROLLS

Figure 1:
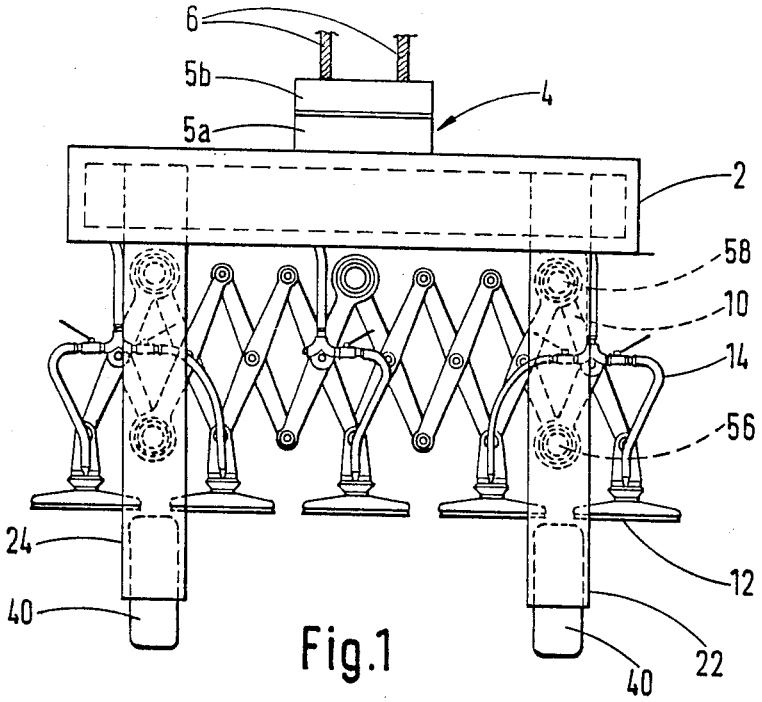

The present invention relates to a hoisting apparatus for groupwise transfer, i.e. hoisting and lowering, of cargo units in the form of substantially uniform cargo pieces, such as paper rolls, bales, boxes, drums and the like.

The invention more particularly relates to a means for automatic positioning of gripper means such as vacuum cups in order to space the same relative to the center distance between the cargo units in the group to be transferred.

The invention is particularly developed for groupwise transfer of paper rolls and shall in the following be described and illustrated for such use, but it shall be understood that the invention with similar advantages can be utilized for groupwise transfer of other kinds of unit cargo such as bales, boxes, containers and the like.

In the following specification the gripper means are specified as vacuum lifters or vacuum cups, but it shall be understood that the invention can be utilized with other forms for gripper means, for instance magnetic grippers or lifters or mechanical gripper means.

In known cargo systems for handling standard paper rolls arranged side by side in parallel rows adjacent each other the rolls having the same length or height, but possibly slightly varying diameter, a group of the rolls usually is grasped at the time and lifted by means of socalled vacuum cups. The cups are suspended in two or more parallel rows in an overhanging hoisting bank, usually an extensible and retractable pantographic socalled zigzag frame such that the center distance between the vacuum cups can be adjusted to fit the center distance between the rolls in the selected groups to be transferred. The vacuum cups are usually given a diameter somewhat smaller than the applicable central area or core of the rolls, such that a certain variation in the distance between the center of the rolls can be tolerated, without necessitating adjustments, but adjustments are most often required. The hoisting bank with the cups is suspended below a socalled turntable, the pivoting of which is controlled by the crane operator.

As illustrative for the prior art can be referred to Norwegian patent specification Nos. 133.886 and No. 135.521. In the latter patent are shown two steering or guiding rams, one arm mounted at each end of the hoisting bank, the arms in active position being positioned lower than the vacuum cups. The crane operator lowers the hoisting bank over the group to be transferred such that the control arms come into contact with one or more of the cargo units at each end of the group. The crane operator thereafter adjusts, i.e. extends or retracts the hoisting ramp, by eyesight, until the guiding arms come in position between suitably the two outermost units at each end of the long side of the group in order to ensure correct positioning of the vacuum cups. The problem in connection with this solution is that the crane operator, who very often is positioned far above the cargo, for instance 40–50 meters above the place where the cargo must be picked up, hardly can observe the exact position of the hoisting ramp, i.e. control that the actual center distance between the vacuum cups conforms to the center distance between the cargo units. For this reason a skilled operator must always stand by when lowering the hoisting ramp on to the group of cargo to be lifted, and give signs or otherwise communicate with the crane operator who thereafter, when he assumes everything is in order, lowers the vacuum cups and actuates the same in order to hoist up the selected group of cargo units.

Especially when using grippers such as vacuum cups, it is very important that the cups are positioned centrally on the paper rolls. Only slightly displaced positioning of the vacuum cups on the rolls will imply that the rolls will be hanging at a tilt, a fact which again implies that the gripping force of the cups is greatly reduced. A displaced positioning of for instance 5 centimeters may imply that the rolls get a tilt of about 7° from the vertical, and this again can result in up to 50% reduction of the gripping force. In this connection one ought to realize that great dimensions and weights are involved.

Each paper roll thus has a diameter up to 100 centimeters and weighs more than 500 kilos. In regard the distances involved it can be mentioned that from the position of the crane operator down to the bottom of a cargo room in a ship, the height frequently is up to 45 meters. An uncorrect positioning of the vacuum cups frequently has in result that a roll is falling off the gripper in large height above the cargo, resulting in large damages on the cargo and of course implying a great risk for hurting individuals.

Known equipment for cargo handling of the above described type must in general be considered rudimentary in construction, cumbersome in use and hampered with unreliability and danger for the environments.

The main object for the present invention is to provide means for a speedy and more reliable positioning of the gripper means in connection with groupwise handling and transfer of a cargo unit such as paper rolls and the like.

The hoisting apparatus in accordance with the invention is of the kind comprising a hoisting bank provided with a number of horizontally spaced mutually adjustable gripper means, such as vacuum cups, the hoisting bank including one or more guiding arms designed for contacting the cargo units in the group to be lifted in order to adjust the position of the gripper means relative to the cargo units prior to that the grippers are positioned on the cargo units, and the invention is characterized in that at least one guiding arm is provided with sensors adapted for contacting an adjacent cargo unit or units and furthermore being such deviced that in dependence upon the outer contour of the adjacent cargo unit is able to effectuate extension, respectively retraction, of the mutual distance between the gripper means relative to the center distance between the cargo units in the group.

Upon correct positioning of the hoisting bank, the crane operator will automatically be given a signal when the hoisting bank and the vacuum cups are in correct position above the cargo group whereupon the crane operator lowers the hoisting bank with the cups such that the cups seat themselves on top of the rolls to be lifted. Thereafter the crane operator actuates the cups and starts the hoisting of said selected group of cargo. Extensive trials with practical embodiments of the invention have shown that utilization of the invention results in quick and safe positioning of the vacuum cups, resulting in, among other advantages, more effective and safer cargo handling, and reduces also the need for extra personel stationed aside the cargo apparatus.

It will be understood that a device in accordance with the invention is based on the principle that the sensor means is controlling and sensing the outer contour of the adjacent cargo unit and effectuate, if required, an adjustment of the length of the cargo bank in correspondence with the position of the sensor means against the cargo. With the before-mentioned embodiment of the invention for handling of paper rolls one operates with circular cargo units, i.e. cargo units having a circular external surface, but it will be understood that the invention can be adapted for handling cargo units having a different external contour, since the aim of the adjustment means is to provide that the guiding arm or arms automatically position themselves between two adjacent cargo units and thereby effectuate a corresponding adjustment of the length of the hoisting ramp and thereby the center distance between the gripper means. If the cargo units for instance consists of square units (seen from above), for instance boxes or bales, there will still exist a variation of contour between two adjacent cargo units, and one must then only see to that the sensor means have a such configuration that they automatically seek their way to the joint or opening between two adjacent cargo units. In many embodiments one will use two guiding arms each having sensor means as described and designed to be brought into contact with cargo units located at the respective ends of a group of cargo to be transferred. With such embodiments one can arbitrarily select one of the arms or the other to be the first arm to be brought into contact with the cargo. When then bringing the other arm into contact with the cargo, the sensor means on the guiding arms will effectuate necessary adjustment of the hoisting bank such that the center distances between the gripper means will fit the center distances between the cargo units in the selected group.

The sensor means or elements can be made to function in accordance with different technical principles. One can for example utilize light sensitive devices, pressure sensitive actuators, or other solutions.

In the following one shall, however, describe a simple mechanical embodiment whereby the sensor consists of two segment- or sector shaped, spring biased sliding blocks each of which actuate a micro switch when being displaced radially. The micro switches are connected to relays outside the sensor elements, and which further control hydraulic or magnetic valves for adjustment of the length of the hoisting bank and thereby the center distances between the gripper means, i.e. the vacuum cups. The circuit for the micro switches is such that when both switches are impressed by the sensor elements, both relays will be turned off. A further micro switch is positioned between the sensor such that this only gives contact when both are impressed. This switch is connected to an external relay which for instance controls a signal lamp mounted on the top side of the hoisting ramp.

The invention shall in the following be described with reference to the attached drawings and in connection with an embodiment for a cargo handling unit, especially designed for handling paper rolls.

Figure 2:
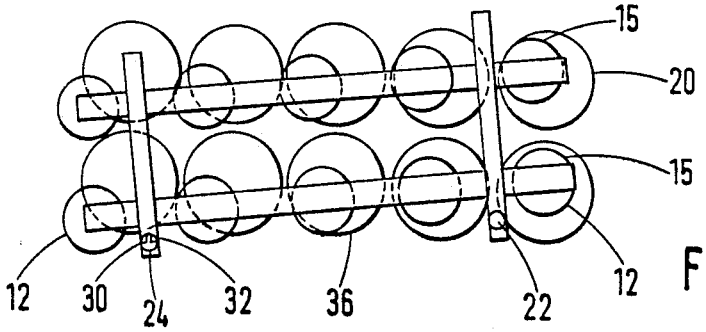
Figure 3:
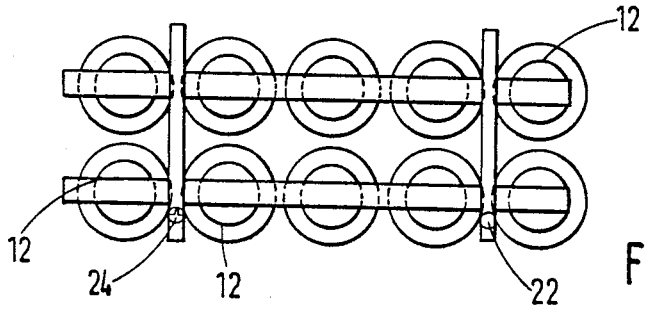
Figure 4:
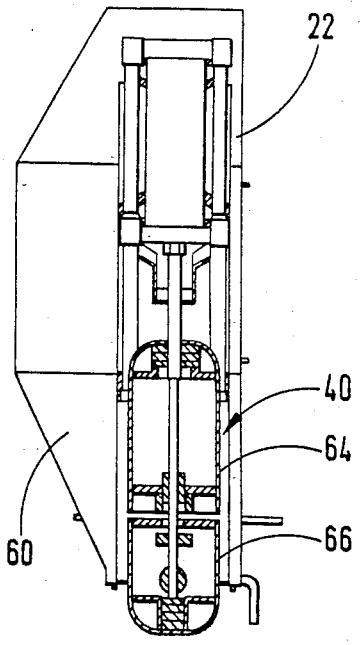
Figure 5:
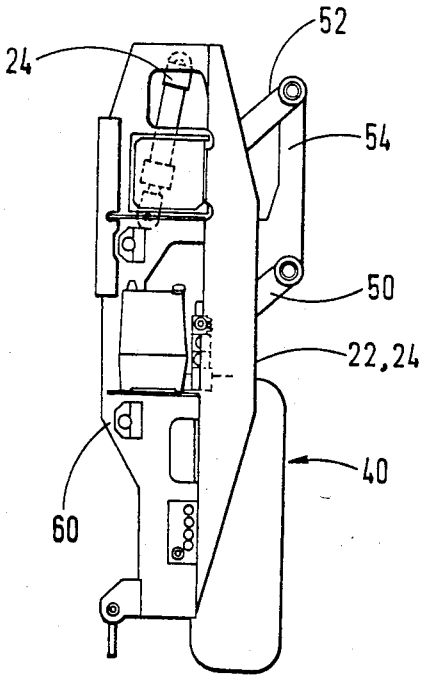
Figure 8:
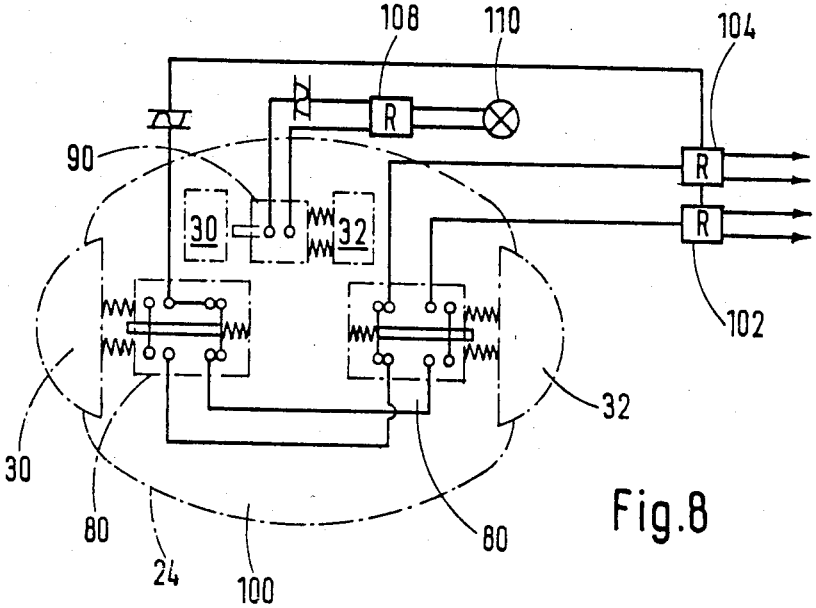
Figure 6:
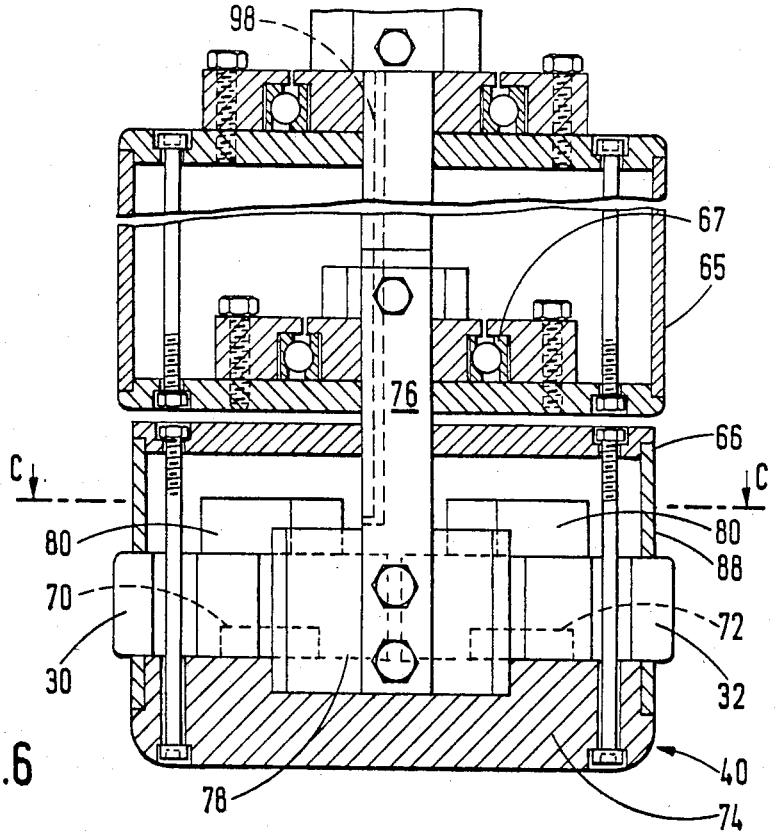
Figure 7:
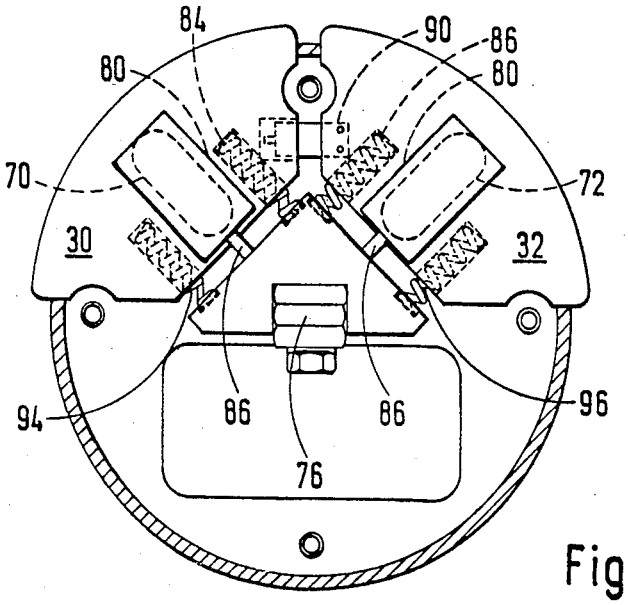

In the attached drawings where equal numbers refer to equal parts,

FIG. 1 is a schematic lateral view of a hoisting apparatus including the device in accordance with the invention, FIG. 2 is a schematic plan view of the hoisting apparatus shown in FIG. 1, the same suspended in substantially correct position above a group of paper rolls (10 rolls) which shall be hoisted, FIG. 3 is a plan view similar to FIG. 2, wherein the hoisting means are correctly positioned straight above the selected group of paper rolls, FIGS. 4 and 5 are showing a lateral view and an end view, respectively, and partly in section, of the guiding arms including the sensor means in accordance with the invention, FIGS. 6 and 7 are showing in an enlarged scale a front view partly in section, and a plan view along the plane C—C shown in FIG. 6, respectively, of the device in accordance with the invention, some parts removed for the sake of clarity, and, FIG. 8 is showing an electric circuit for actuation and control of the sensor means.

The FIGS. 1, 2 and 3 show somewhat schematically a cargo handling apparatus of the kind which is of present interest in connection with the device in accordance with the invention. As best shown in FIG. 1 the hoisting apparatus consists of a hoisting ramp or bank 2 which centrally on the top side is provided with a turntable 4 adapted for attachment of one or more hoisting cables 6. The turntable 4 consists of two disks 5*a* and 5*b* which can be pivoted relative each other about a vertical axis by means of not shown power means. These power means are controlled by the crane operator who hereby can turn the entire hoisting apparatus as shown about a vertical axis. The hoisting bank 2 includes hydraulic or pneumatic control means to carry out extensions, respectively retractions, of a zigzag or socalled pantograph arm system 10 suspended from the underside of the bank 2 and on the various links of which are mounted a plurality of vacuum cups 12, in the shown embodiment five in the row, the hoisting apparatus in the shown embodiment comprising two parallel rows of cups as it appears from FIGS. 2 and 3. The vacuum cups are connected to a pipeline and hose system 14 further connected to a not shown vacuum system which also is controlled by the crane operator.

The crane operator is in connection with such hoisting apparatus usually positioned in a crane housing mounted on a trolley carriage on an elevated gantry crane mounted across the ship. The crane operator can maneouvre the shown hoisting apparatus between the floor of the ship and an adjacent pier, in order to transfer cargo from the ship to the pier and vice versa. The crane operator can further by extending, respectively retracting, the suspension system on the hoisting bank 2, likewise extend, respectively retract, the pantographic arm system effecting an extension, respective retraction, of the center distance between the cups in each group. By means of this system the crane operator is able to position the vacuum straight above a group of paper rolls for instance resting on the floor in the ship. This situation is illustrated in FIGS. 2 and 3.

In FIGS. 2 and 3 the reference number 20 designates a group of ten paper rolls positioned in two rows, each comprising five rolls. The hoisting apparatus is further as shown provided with two socalled guiding arms 22 and 24 which are suspended in the pantograph arm system as shown in FIG. 1, such that the guiding arms have position between the two outermost vacuum cups at each end of the group. The guiding arms are usually hoistable, preferably pivotable, from an upper position substantially level with the underside of the vacuum cups and a lower position wherein the guiding arms point vertically and are adapted for contacting adjacent paper rolls. The guiding arms 22, 24, are also shown in FIGS. 2 and 3. What hitherto is described about the hoisting apparatus belongs to the prior art and known technique. In FIG. 2 the hoisting apparatus is shown when hanging in a socalled preliminary step just above a group of paper rolls 20 which shall be hoisted up. In order to position the hoisting bank with the vacuum cups in correct position on the top side of the paper rolls the crane operator initially maneouvres the hoisting bank such that for instance the guiding arm 22 on the right side moves into the opening or cleft between two paper rolls. This situation is illustrated in FIG. 2. Thereafter the crane operator maneouvres the hoisting bank somewhat over to the opposite side simultaneously as the operator by means of eyesight or for instance hand signals from an assistant, extends or retracts the pantograph arm system such that also the other guiding arm 24 positions itself in the opening or cleft between the two paper rolls positioned at the opposite end of the same row such as illustrated in FIG. 3. Also the just described method belongs to known technique.

In accordance with one embodiment of the present invention one of the guiding arms, in the shown example the left one, is provided with two sensor elements which automatically effectuate the necessary extension, respectively retraction, of the length of the pantograph arm system and thereby effects the necessary adjustment of the distance between the vacuum cups in order to conform with the distance between the paper rolls. The direction of adjustment movement takes place in dependence upon which sensor element is the first one to contact an adjacent paper roll when the crane operator turns the hoisting bank in direction towards the opposite side of said group of paper rolls. Expressed in other words, an automatic adjustment of the center distance between the vacuum rolls takes place by utilizing the external configuration or contour of the cargo units, in the shown example, paper rolls.

The sensor means in accordance with the invention must be arranged not rotatable relative to the hoisting bank and the vacuum cups and they are each mounted in a sector of a circle positioned at each side from a center line directed transversely of the hoisting ramp, such as shown schematically in FIG. 2 at the reference numbers 30 and 32. When the left guiding arm shown in FIG. 2 hits against the adjacent paper roll, the left sensor element hits against the paper roll, effectuating through a not shown control system that the pantograph arm system is being retracted such that the guiding arm moves to the right until the other sensor element 32 hits against the adjacent paper roll, designated with the number 36. When this occurs, the guiding arm 24 will substantially be positioned in the opening or clift in the middle between the shown two adjacent paper rolls, having into effect that the vacuum cups simultaneously have been correct positioned above the paper rolls. Thereby the entire hoisting bank can be lowered down into position such that the vacuum cups rest against the top surface of the paper rolls such as illustrated in FIG. 3. In FIG. 2 is shown how the vacuum cups initially (in broken lines) have a displaced position too far at left with progressively increasing displacement from the right to the left, and the vacuum cups 15 on the right side end will be correctly positioned when the right guiding arm 22 contacts the paper rolls. With this solution the crane operator can only see to that the right guiding arm 22 comes into position in the cleft between the two paper rolls on the right side, whereafter the hoisting bank is pivoted laterally until the guiding arm 24 hits against the outermost paper roll at the left. The sensor element with the control system coupled thereto will thereupon automatically provide for that the guiding arm and thereby the vacuum cups position themselves correctly. One may perhaps object that if the guiding arm 24 hits against the external side of the roll at the left end of the row, then the hoisting bank will extend itself instead of retract, but in practice it has been verified that it is rather easy for the crane operator to control a sufficiently correct position of the hoisting bank such that the guiding arm 24 always will hit or contact the rolls in the vicinity between the outermost roll in the row and the next one on the inside thereof, and that is all what is necessary to provide for an automatic positioning of the vacuum cups.

FIGS. 4 to 7 show in detail an embodiment for the sensor means to be used in connection with the guiding arms.

FIGS. 4 and 5 show the guiding arms from the side and from the end, respectively. The guiding arms 22, 24 are mounted on the pantograph system by means of coupled arms 50, 52 which are pivotally supported on a support arm 54 which is fixed to the pantograph arms at the points 56, 68 as shown in FIG. 1. The guiding arms include a box 60 housing in per se known operating equipment, such that the guiding arms can be pivoted between an upper and a lower position. The guiding arms include a cylinder or roll 40 adapted for contact with the paper rolls. In connection with the present invention this cylinder (refer to the fragmentary section shown in FIG. 4), divided up in two sections, namely an upper section 64 which can be freely rotatable, and a lower section 66 which is non-rotatably mounted relative to the pantograph system. In this non-rotatable roller 66 is positioned the special sensor means in accordance with the invention. The shown solution for the sensor means is shown in detail in FIGS. 6 and 7.

FIG. 6 is showing a section through the cylinder or roll 10 which includes the sensor elements in accordance with the invention. The reference number 65 designates a part of the upper rotatable roller, cf. the roller bearing 67, while the non-rotatable cylinder in accordance with the invention is designated with the number 66. The sensor elements themselves consist in the shown embodiment of two sector-shaped sensor members 30,32 (cf. FIG. 2). 70, 72 designate two guiding blocks for the sensors which are rigidly connected to a bottom plate 74 and which circumscribe a countersink or slit in the sensors. A centrally positioned vertical support arm or shaft 76 for the guiding arm 24 is rigidly connected to a clamp 78 which again is mounted to the bottom plate 74. Two enclosed micro switches 80 are mounted on the top side of each sensor 30, 32 and are actuated via springs 84 and biasing points 86 against the support cleat 78. Sensors 30, 32 extend along their outer periphery a certain distance beyond the outer mantle 88 of the guiding arm through slits. The diameter of the outer mantle 88 may be equal to or slightly smaller than the diameter of the upper, freely rotating section 65 of the guiding arm 24. A further micro switch 90 is mounted between the two sensors 30, 32 in a such way that when sensors 30, 32 are coming closer to each other in that one or the other is being pressed inwards, alternatively that both are pushed inwards simultaneously, the micro switch 90 will alter the control circuits. As best appears from FIG. 7 the sensors 30 and 32 are kept biased against their limit positions by means of two springs 94, 96, and they are otherwise guided in radial direction by means of sliding cleats 78 while the sensors are fixed in axial direction by the wall surfaces or edges in the opening of the external mantle 88. The shaft 76 includes further a tube 98 for the necessary cables to the micro switches 80 and 90 up to the control relays etc. positioned in the hoisting apparatus in order to effectuate the desired lengthwise adjustment of the pantograph arms and thereby the center distance between the various vacuum cups. These means must be assumed to be of conventional type and should not be necessary to describe in detail.

FIG. 8 shows an electric circuit diagram with the micro switches 80, 80 arranged such that contact for power supply only takes place when only one of the switches is actuated, but not if both are in the outer position, or if both are in the retracted, pushed-in position. Outside the sensor unit 100 is positioned a relay 102 which gives an impulse for reduction of the center distance between the vacuum cups, and one relay 104 which gives an impulse for increasing the center distance. Micro switch 90 will only render contact when both sensors 30, 32 are pressed in simultaneously and will further via a relay 108 control the power to a signal lamp 110 mounted on the hoisting apparatus or in the crane operator's cabin.

The function of the device in accordance with the invention for automatic positioning of the center distance between the vacuum cups will be fully understood from the following description. When for instance the left sensor 30 (see FIG. 2 and 7) hits against the outside of an adjacent paper roll, that is on the "inside" of the outermost paper roll (the surface pointing towards the right), this will effect a retraction of the pantograph arm system, and this lengthwise reduction will continue until the other sensor 32 hits the surface of the adjacent paper roll and actuates micro switch 90. Thereby the lengthwise adjustment of the pantograph arm system will immediately stop, and in this position the guiding arm will be positioned in the center of the cleft between two paper rolls such as illustrated in FIG. 3.

In the Figures and in the foregoing description is only described special sensor means mounted on the guiding arm shown to the left, but it will for many applications be of interest also to mount such sensor means on the guiding arm to the right, since one will thereby have a free choice in regard which of the guiding arms initially shall be positioned between two adjacent cargo units, in this example paper rolls.

It will furthermore be understood that the design of the sensor means can be modified in many ways, and the outer contour and construction of the sensor means otherwise must be adapted to the dimensions and shape of the cargo units in question. It is, however, obvious that the invention can be utilized with other kinds of unit cargo than paper rolls, and which suitably are handled, i.e. loaded and deloaded, in groups. It is thus clear that the invention easily can be adapted for handling for instance bales, or for barrels and containers of various kinds. If the cargo units should for instance consist of cargo having substantially plane side surfaces, for instance being squarely shaped or rectangular in plan view, one may for instance make the sensor elements such that they generate an automatic adjustment of the pantograph arm system until the sensor elements are positioned in or over the joint or clearance between two adjacent cargo units. In other words, it should be understood that the utilization of the invention is not limited to cargo units which have a more or less circular shape in plan view.

It is furthermore realized that in replacement of circular segment-shaped spring biased sensors such as shown in the Figures, one can utilize elastic or flexible contact elements, for instance of the type used in so-called "cable-counters" of the kind used for counting automobile traffic, i.e. vehicles passing a certain point of a road. In these cables are positioned two parallel, preferably bandshaped conductors between which are positioned spaced isolating pieces, such that when the cable is compressed, the conductors will be pressed against each other and make electric contact. Pieces of a such contact medium can be arranged along the circumference of the guiding arm and thereby replace the shown sensor elements. Furthermore can be used only one sensor member instead of two as shown. A such solution can be used in connection with cargo units which have a substantially plane side surface, but which can be positioned with a smaller or larger intermediate clearance, if necessary, by arranging special cleats or spacers therebetween. In connection with such cargo units one separate sensor member can be used, since a such sensor member can provide for that the pantograph arm system is being lengthwise adjusted until the sensor member attains position between two adjacent cargo units.

We claim:

1. In a hoisting apparatus for group-wise transfer of cargo units, such as paper rolls, drums or the like, a hoisting bank of the kind having a plurality of horizontally spaced mutually adjustable gripper means such as vacuum cups for gripping and holding a group of side by side positioned cargo units, said hoisting bank provided with one or more guiding arms for effecting lateral adjustment of said gripping means relative to the cargo units prior to positioning of said grippers onto said cargo units, wherein at least one of said guiding arms (24) is provided with at least two sensors (40,32,32) operable upon contact with said cargo to effect said adjustment of the gripper means relative to the cargo units, one of said sensor means effective to reduce a distance between said grippers, the other sensor effective to extend said distance, said sensors being formed and positioned such that a first one of said sensors initially contacts said cargo in dependence of the contour of said cargo and effecting the required gripper adjustment.

2. Apparatus according to claim 1, wherein simultaneously actuation of both sensors as the result of simultaneous contact with adjacent cargo produces no resulting adjustment of the gripper means.

3. Apparatus according to claim 1 wherein simultaneous actuation of both sensors as the result of simultaneous contact with adjacent cargo discontinues ongoing adjustment of said gripper means.

4. Apparatus according to claim 2 wherein said simultaneous actuation discontinues ongoing adjustment of said gripper means.

5. Apparatus according to claim 1, wherein said two sensors (30,32) are non-rotatably mounted side by side on one of said guiding arms (24), each located on either side of a center line extending transversely of the longitudinal direction of the hoisting bank and facing the cargo in an operative position.

6. Apparatus according to claim 1, wherein an outwardly pointing contact surface of each sensor is substantially configurated as a sector of a circle in plan view.

7. Apparatus according to claim 1, wherein said guiding arm (24) is divided in two sections in a vertical direction, an upper section (65) consisting of a freely rotatable roller and a lower section (66) which is non-rotatably mounted relative to the hoisting bank which contains said sensors (30,32).

8. Apparatus according to claim 1, wherein said sensors (30,32) are spring biased and connected to micro switches forming part of an electric control circuit, said switches being actuated when the sensors are pressed inwards from a normal, inoperative position.

9. Apparatus according to claim 6, wherein said guiding arm (24) is divided in two sections in a vertical direction, an upper section (65) consisting of a freely rotatable roller and a lower section (66) which is non-rotatably mounted relative to the hoisting bank which contains said sensors (30,32).

10. Apparatus according to claim 9, wherein said sensors (30,32) are spring biased and connected to micro switches forming part of an electric control circuit, said switches being actuated when the sensors are pressed inwards from a normal, inoperative position.

11. Apparatus according to claim 6, wherein said sector is a 90° sector in plan view.

* * * * *